US006755038B2

(12) United States Patent
Hwang

(10) Patent No.: US 6,755,038 B2
(45) Date of Patent: Jun. 29, 2004

(54) MULTI-UNIT AIR CONDITIONER AND METHOD FOR CONTROLLING THE SAME

(75) Inventor: Il Nahm Hwang, Ansan-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/459,431

(22) Filed: Jun. 12, 2003

(65) Prior Publication Data

US 2003/0230100 A1 Dec. 18, 2003

(30) Foreign Application Priority Data

Jun. 12, 2002 (KR) ..... P2002-0032899

(51) Int. Cl.[7] ..... F25B 39/04
(52) U.S. Cl. ..... 62/184; 62/175
(58) Field of Search ..... 62/181, 183, 184, 62/203, 175, 510, 509

(56) References Cited

U.S. PATENT DOCUMENTS 5,142,879 A 9/1992 Nakamura et al.
5,388,422 A 2/1995 Hayashida et al.
5,768,902 A * 6/1998 Nonaka et al. ..... 62/183
5,927,087 A * 7/1999 Ishikawa ..... 62/174

FOREIGN PATENT DOCUMENTS

EP 0448345 9/1991
EP 0509619 10/1992

* cited by examiner

*Primary Examiner*—Marc Norman
(74) *Attorney, Agent, or Firm*—Greenblum & Bernstein, P.L.C.

(57) ABSTRACT

Multi-unit air conditioner and method for controlling the same, the multi-unit air conditioner including a plurality of outdoor heat exchangers, a plurality of outdoor fans for cooling the outdoor heat exchangers, and control means for controlling rotation speeds of the outdoor fans, to control a gas/liquid refrigerant mixing ratio introduced into the gas-liquid separator through the outdoor heat exchangers, thereby optimizing the mixing ratio of the refrigerant introduced to a gas-liquid separator proper to an operation condition, for improving an air conditioning efficiency. The control means including a temperature sensor for measuring a temperature of refrigerant introduced from the outdoor heat exchangers into the gas-liquid separator, and a microcomputer for comparing a refrigerant temperature measured with the temperature sensor and a preset refrigerant temperature, to detect a refrigerant mixing ratio at the outdoor unit piping system, and controlling rotation speeds of the outdoor fans so that detected refrigerant mixing ratios are the same with refrigerant mixing ratios preset to be proper to operation conditions, respectively.

20 Claims, 5 Drawing Sheets

MULTI-UNIT AIR CONDITIONER AND METHOD FOR CONTROLLING THE SAME

This application claims the benefit of the Korean Application No. P2002-32899 filed on Jun. 12, 2002, which is hereby incorporated by reference.

BACKGROUND OF THE INVENTION

1. Field of the Invention

The present invention relates to a multi-unit air conditioner, and a method for controlling the same.

2. Background of the Related Art

In general, the air conditioner is an appliance for cooling or heating spaces, such as living spaces, restaurants, and offices. At present, for effective cooling or heating of a space partitioned into many rooms, there have been ceaseless developments of multi-unit air conditioners. The multi-unit air conditioner is in general provided with one outdoor unit and a plurality of indoor units each connected to the outdoor unit and installed in a room, for cooling or heating the room while operating in either a cooling or heating mode.

However, since the multi-unit air conditioner is operable only either in the cooling or heating mode uniformly even if some of the rooms within the partitioned space require heating, and rest of the rooms require cooling, the multi-unit air conditioner has a limit in that the requirement can not be met, properly.

For an example, even in a building, there are rooms having a temperature difference depending on locations of the rooms or time of the day, such that while a north side room of the building requires heating, a south side room of the building requires cooling due to the sun light, which can not be dealt with a related art multi-unit air conditioner that is only operable in a single mode.

Moreover, even though a building equipped with a computer room requires cooling not only in summer, but also in winter for solving the problem of heat load from the computer related equipment, the related art multi-unit air conditioner can not deal with such a requirement, properly.

In conclusion, the requirement demands development of a multi-unit air conditioner and a method for controlling the same that can air condition rooms individually, i.e., the indoor unit installed in a room requiring heating is operable in a heating mode, and, at the same time, the indoor unit installed in a room requiring cooling is operable in a cooling mode.

SUMMARY OF THE INVENTION

Accordingly, the present invention is directed to a multi-unit air conditioner and a method for controlling the same that substantially obviates one or more of the problems due to limitations and disadvantages of the related art.

An object of the present invention is to provide a multi-unit air conditioner and a method for controlling the same which can carry out cooling operation and heating operation at the same time.

Another object of the present invention is to provide a multi-unit air conditioner and a method for controlling the same, in which a piping system connecting a distributor and indoor units are simplified, to easy piping work in installation of the indoor units and improving outer appearance.

Further object of the present invention is to provide a multi-unit air conditioner and a method for controlling the same, in which a mixing ratio of refrigerant introduced into a gas-liquid separator is optimized for different operation conditions for improving an air conditioning efficiency of the multi-unit air conditioner.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the multi-unit air conditioner includes an outdoor unit including an accumulator, a plurality of compressors and outdoor heat exchangers connected with an outdoor unit piping system, plurality of outdoor fans for respectively cooling the outdoor heat exchangers, a four way valve and a plurality of control valves mounted on the outdoor unit piping system for controlling refrigerant flow, a plurality of indoor units respectively installed in rooms each having an indoor heat exchanger and an electronic expansion valve, a distributor including a gas-liquid separator for separating refrigerant received from the outdoor unit into gas refrigerant and liquid refrigerant, or mixing refrigerant received from the indoor units, and a distribution piping system for guiding the refrigerant from the outdoor unit toward the indoor units and the refrigerant from the indoor units to the outdoor unit again, and control means for controlling rotation speeds of the outdoor fans, to control a gas/liquid refrigerant mixing ratio introduced into the gas-liquid separator through the outdoor heat exchangers.

The outdoor heat exchanger includes a first outdoor heat exchanger for discharging liquid refrigerant proper to an operation condition, and a second outdoor heat exchanger for discharging two phased refrigerant proper to the operation condition.

The outdoor fan includes a first outdoor fan for condensing refrigerant at the first outdoor heat exchanger, and a second outdoor fan for condensing refrigerant at the second outdoor heat exchanger.

The control means includes a temperature sensor for measuring a temperature of refrigerant introduced from the outdoor heat exchangers into the gas-liquid separator, and a microcomputer for comparing a refrigerant temperature measured with the temperature sensor and a preset refrigerant temperature, to detect a refrigerant mixing ratio at the outdoor unit piping system, and controlling rotation speeds of the outdoor fans so that detected refrigerant mixing ratios are the same with refrigerant mixing ratios preset to be proper to operation conditions, respectively. The refrigerant is R407C mix refrigerant of which refrigerant mixing ratio can be known accurately according to a temperature variation.

The outdoor unit piping system includes a first pipeline connected between outlets of the compressors and the four way valve, a second pipeline branched into two pipeline in front of the first and second outdoor heat exchangers, and connected between the four way valve and the first and second outdoor heat exchangers in parallel, a third pipeline joined in front of the gas-liquid separator, and connected between the gas-liquid separator and the outdoor heat exchangers in parallel, a fourth pipeline connected between the distribution piping system and the four way valve, a fifth pipeline connected between the four way valve and the accumulator, and a sixth pipeline connected between the accumulator and an inlet of the compressor.

The outdoor heat exchangers include a first outdoor heat exchanger for discharging liquid refrigerant proper to an operation condition, and a second outdoor heat exchanger for discharging two phased refrigerant proper to the operation condition. The outdoor fans include a first outdoor fan for condensing refrigerant at the first outdoor heat exchanger, and a second outdoor fan for condensing refrigerant at the second outdoor heat exchanger.

The control means includes a temperature sensor provided at a part the third pipeline joins for measuring a temperature of refrigerant introduced from the first and second outdoor heat exchangers into the gas-liquid separator, and a microcomputer for comparing a refrigerant temperature measured with the temperature sensor and a preset refrigerant temperature, to detect a refrigerant mixing ratio at the outdoor unit piping system, and controlling a rotation speed of the second outdoor fan so that detected refrigerant mixing ratios are the same with refrigerant mixing ratios preset to be proper to operation conditions, respectively.

The control valve includes first, and second check valves provided on sides of the first, and second outdoor heat exchangers of the third pipeline for controlling a refrigerant flow from the first and second outdoor heat exchangers to the gas-liquid separator, and first and second electronic expansion valves provided in parallel with the first and second check valves for expanding refrigerant flowing from the gas-liquid separator to the first and second outdoor heat exchangers.

The distribution piping system includes a liquid refrigerant pipeline connected to the gas-liquid separator for guiding liquid refrigerant to/from the gas-liquid separator, liquid refrigerant branch pipelines branched from the liquid refrigerant pipeline, and connected to the indoor heat exchangers respectively, a gas refrigerant pipeline connected to the gas-liquid separator for guiding gas refrigerant to/from the gas-liquid separator, gas refrigerant branch pipelines branched from the gas refrigerant pipeline and connected to the indoor heat exchangers, respectively, and intermediate branch pipelines respectively branched from the gas refrigerant branch pipelines, and connected to the outdoor unit piping system.

The gas refrigerant branch pipelines and the liquid refrigerant branch pipelines are arranged in parallel to each other for piping work efficiency. The outdoor heat exchanger includes a first outdoor heat exchanger for discharging liquid refrigerant proper to an operation condition, and a second outdoor heat exchanger for discharging two phased refrigerant proper to the operation condition. The outdoor fans include a first outdoor fan for condensing refrigerant at the first outdoor heat exchanger, and a second outdoor fan for condensing refrigerant at the second outdoor heat exchanger.

The outdoor unit piping system includes a first pipeline connected between outlets of the compressors and the four way valve, a second pipeline branched into two pipeline in front of the first and second outdoor heat exchangers, and connected between the four way valve and the first and second outdoor heat exchangers in parallel, a third pipeline joined in front of the gas-liquid separator, and connected between the gas-liquid separator and the first and second outdoor heat exchangers in parallel, a fourth pipeline connected between the intermediate branch pipelines and the four way valve, a fifth pipeline connected between the four way valve and the accumulator, and a sixth pipeline connected between the accumulator and the inlet of the compressor.

The control means includes a temperature sensor provided at a part the third pipeline joins for measuring a temperature of refrigerant introduced from the first and second outdoor heat exchangers into the gas-liquid separator, and a microcomputer for comparing a refrigerant temperature measured with the temperature sensor and a preset refrigerant temperature, to detect a refrigerant mixing ratio at the outdoor unit piping system, and controlling a rotation speed of the second outdoor fan so that detected refrigerant mixing ratios are the same with refrigerant mixing ratios preset to be proper to operation conditions, respectively.

The control valve includes first, and second check valves provided on sides of the first, and second outdoor heat exchangers of the third pipeline for controlling a refrigerant flow from the first and second outdoor heat exchangers to the gas-liquid separator, and first and second electronic expansion valves provided in parallel with the first and second check valves for expanding refrigerant flowing from the gas-liquid separator to the first and second outdoor heat exchangers.

The distributor includes a valve unit for controlling refrigerant flow in the distribution piping system. The valve unit includes two way valves provided on the gas refrigerant branch pipelines, the liquid refrigerant branch pipelines, and intermediate branch pipelines for being turned on/off selectively depending on operation conditions.

In another aspect of the present invention, there is provided a method for operating a multi-unit air conditioner, including the steps of measuring a temperature of refrigerant introduced into a gas-liquid separator through an outdoor unit piping system from a plurality of outdoor heat exchangers with a temperature sensor, comparing a measured refrigerant temperature and a preset refrigerant temperature, to detect a refrigerant mixing ratio flowing through the outdoor unit piping system, and controlling rotation speeds of a plurality of outdoor fans for cooling the outdoor heat exchangers, so that the detected mixing ratio becomes the same with a mixing ratio set proper to an operation condition.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, same parts will be given the same names and reference symbols, and repetitive description of which will be omitted.

Figure 1:
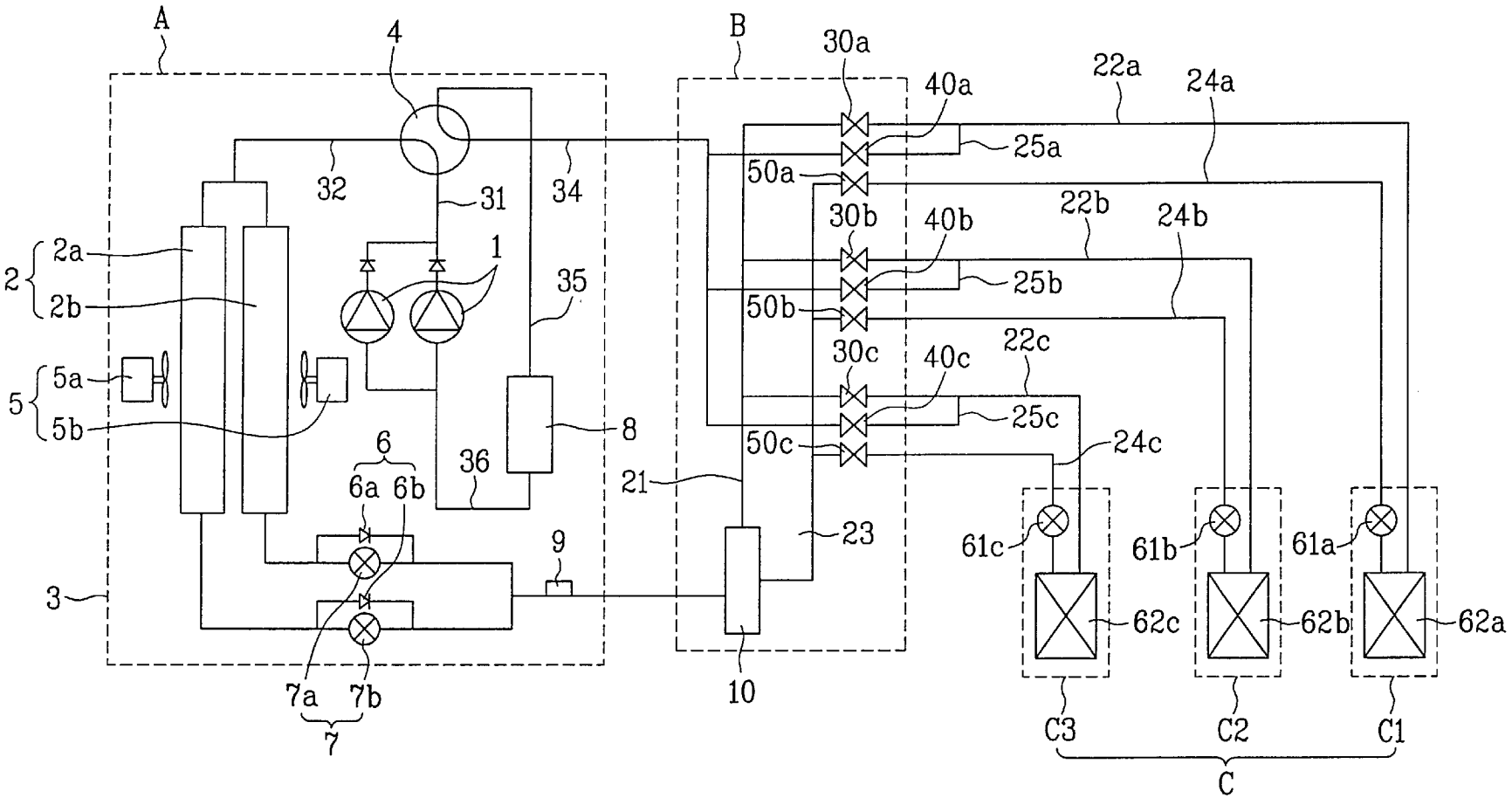
FIG. 1 illustrates a diagram of a multi-unit air conditioner in accordance with a preferred embodiment of the present invention.

Referring to FIG. 1, the multi-unit air conditioner of the present invention includes an outdoor unit 'A', a distributor 'B', and indoor units 'C'.

The outdoor unit 'A' includes a plurality of compressors 1, a plurality of outdoor heat exchangers 2, and an accumulator 8, installed in outdoor. The compressors 1, the outdoor heat exchangers 2, and the accumulator 8 are connected with an outdoor piping system that forms flow passages of the refrigerant. The outdoor heat exchangers 2 have a plurality of outdoor fans 5 for cooling the refrigerant in the outdoor heat exchangers 2. There are a four way valve 4 and a plurality of control valves 6 and 7 in the outdoor piping system for controlling refrigerant flow.

One indoor unit 'C' is installed in one room, and the indoor unit includes an indoor heat exchanger 62*a*, 62*b*, or 62*c*, and an electronic expansion valve 61*a*, 61*b*, or 61*c*.

The distributor 'B' includes a gas-liquid separator 10 for separating refrigerant received from the outdoor unit 'A' into gas refrigerant and liquid refrigerant, or mixing refrigerant received from the indoor units 'C', and distribution piping system for guiding the refrigerant from the outdoor unit 'A' toward the indoor units 'C' and the refrigerant from the indoor units 'C' to the outdoor unit 'A' again.

In the meantime, it is preferable that a mixing ratio of refrigerant is optimized when the refrigerant is introduced into the gas-liquid separator 10 through the outdoor heat exchangers 2 according to an operation condition, for improving an air conditioning efficiency. To do this, the multi-unit air conditioner of the present invention includes control means for controlling rotating speeds of the outdoor fans, so that the mixing ratio of the gas/liquid mixed refrigerant, introduced into the gas-liquid separator 10 through the outdoor heat exchangers 2, is controlled proper to different operation conditions.

Different elements of the multi-unit air conditioner in accordance with a preferred embodiment of the present invention will be described.

The outdoor heat exchangers 2 include first, and second outdoor heat exchangers 2*a*, and 2*b*. The first outdoor heat exchanger 2*a* turns the refrigerant from the compressor 1 into liquid refrigerant and discharges toward the gas-liquid separator 10 according to an operation condition. The second outdoor heat exchanger 2*b* turns the refrigerant from the compressor 1 into refrigerant of a state proper to the operation condition, and discharges to the gas-liquid separator 10.

The outdoor fans 5 include first and second outdoor fans 5*a*, and 5*b*. The first and second outdoor fans 5*a* and 5*b* are designated such that the first outdoor fan 5*a* condenses refrigerant from the first outdoor heat exchanger 2*a*, and the second outdoor fan 5*b* condenses refrigerant from the second outdoor heat exchanger 2*b*.

In the meantime, the control means includes a temperature senor 9 and a microcomputer (not shown). The temperature sensor measures a temperature of the refrigerant introduced from the first, and second outdoor exchangers 2*a* and 2*b* into the gas-liquid separator 10. The microcomputer compares the refrigerant temperature measured with the temperature sensor 9 to a preset refrigerant temperature, to detect the refrigerant mixing ratio in the outdoor unit. The microcomputer also controls rotation speeds of the outdoor fans 5 so that detected refrigerant mixing ratios are respectively the same with the refrigerant mixing ratios preset proper to different operation conditions. In this instance, it is preferable that the microcomputer is designed to control the rotating speed of the second outdoor fan 5*b*. It is also preferable that the refrigerant is one of which gas/liquid mixing ratio can be known accurately, preferably R407C.

The outdoor unit piping system includes a refrigerant path from the outlet of the compressor 1 to the gas-liquid separator 10 or the distribution piping system, and a refrigerant path from the distribution piping system or the gas-liquid separator 10 to the inlet of the compressor 1. The paths are controlled by the four way valve 4. That is, the four way valve 4 makes the outdoor unit piping system on an outlet side of the compressor 1 to be in communication with each other to fix the refrigerant path from the compressor 1, which will be described in more detail.

The outdoor unit piping system includes six pipelines. A first pipeline 31 connects the outlets of the compressors 1 and the four way valve 4. A second pipeline 32 is connected to the four way valve 4, branched into two pipeline in front of the first and second outdoor heat exchangers 2*a* and 2*b*, and connected to the first and second outdoor heat exchangers 2*a* and 2*b*. Therefore, the second pipeline 32 connects the first, and second outdoor heat exchangers 2*a*, and 2*b* in parallel.

A third pipeline 33 is respectively connected to the first and second outdoor heat exchangers 2*a* and 2*b*, joins in front of the gas-liquid separator 10, and connected to the gas-liquid separator 10, to connect the first and second outdoor heat exchanger 2*a* and 2*b* and the gas-liquid separator 10 in parallel. The temperature sensor 9 of the control means is provided at a joined point of the third pipeline 33. A fourth pipeline 34 connects the distribution piping system and the four way valve 4, and a fifth pipeline 35 connects the four way valve 4 and the accumulator 8. Lastly, a sixth pipeline 36 connects the accumulator 8 and the inlet of the compressor 1.

At the end, the four way valve 4 is connected to the first, second, third and fourth pipelines 31, 32, 34, and 35, respectively. The four way valve 4 connects the pipelines selectively depending on operation conditions, and fixes a refrigerant path.

Figure 2A:
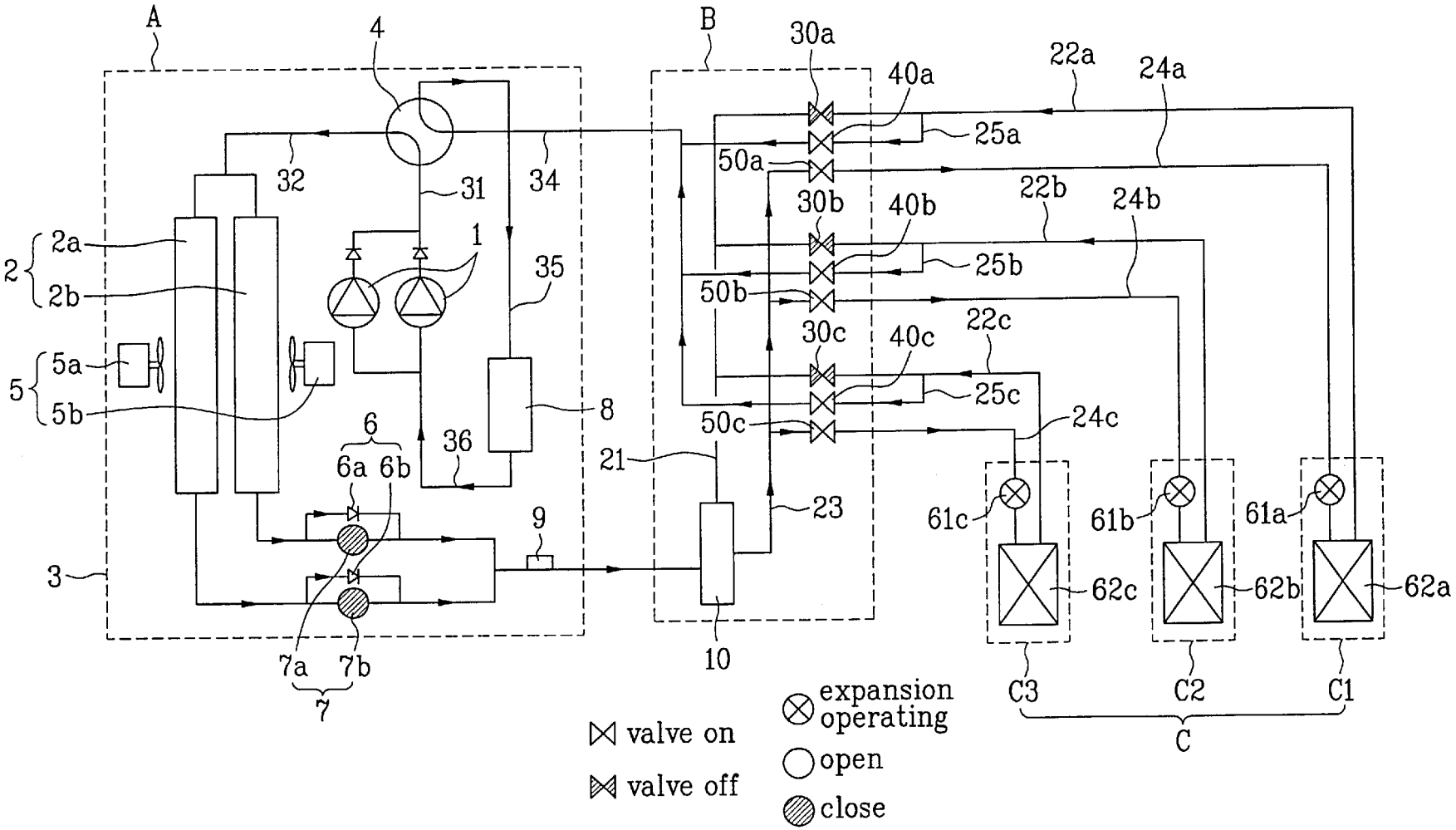
FIG. 2A illustrates a diagram showing an operation state of the multi-unit air conditioner in accordance with a preferred embodiment of the present invention when all rooms are cooled.
Figure 3A:
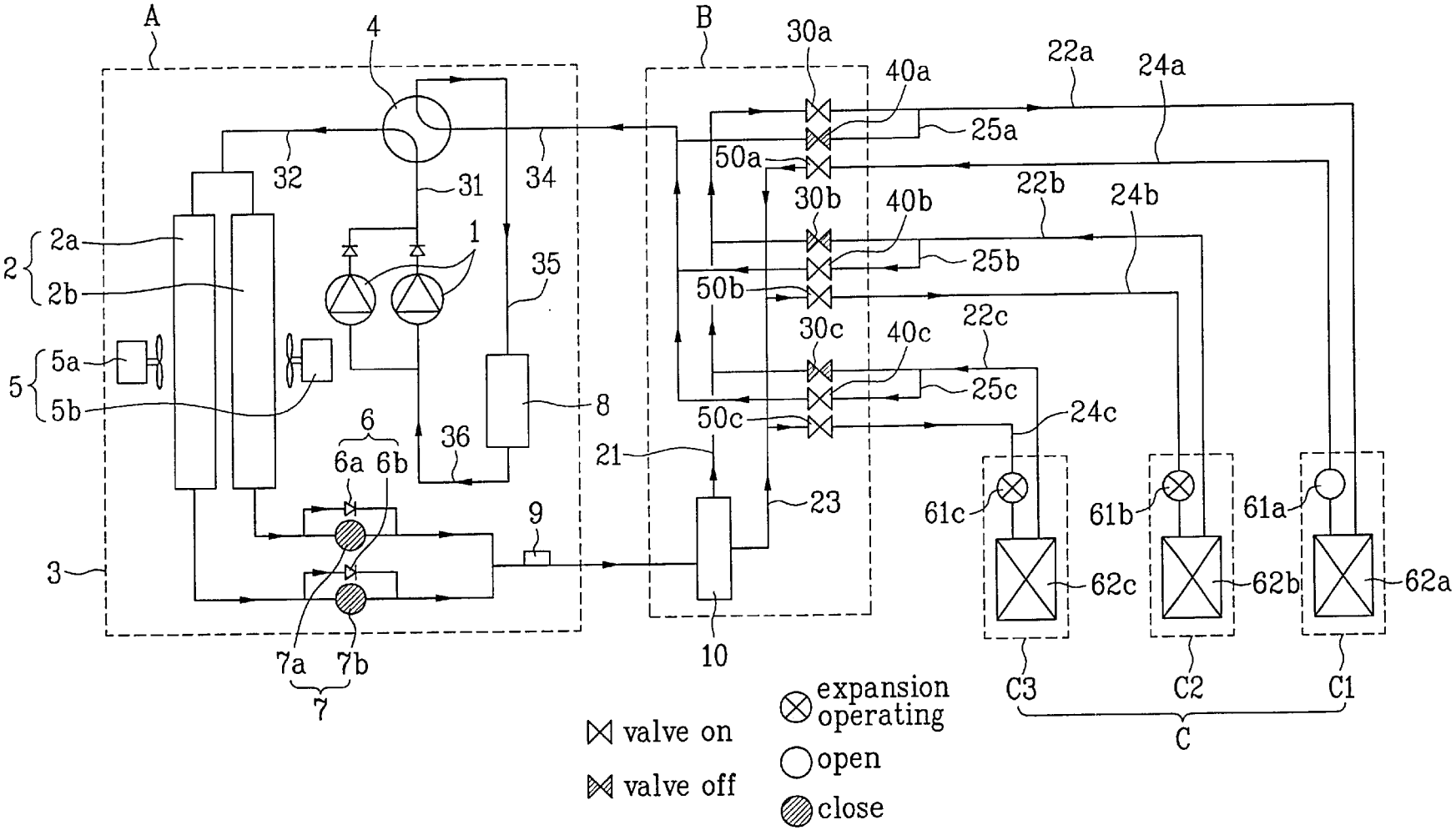
FIG. 3A illustrates a diagram showing an operation state of the multi-unit air conditioner in accordance with a preferred embodiment of the present invention in a major cooling mode.

For an example, referring to FIG. 2A or 3A, when the multi-unit air conditioner is in a cooling mode, the four way valve 4 connects the first pipeline 31 and the second pipeline 32, so as to introduce the refrigerant from the compressor 1 to the outdoor heat exchangers 2*a* and 2*b*.

Figure 2B:
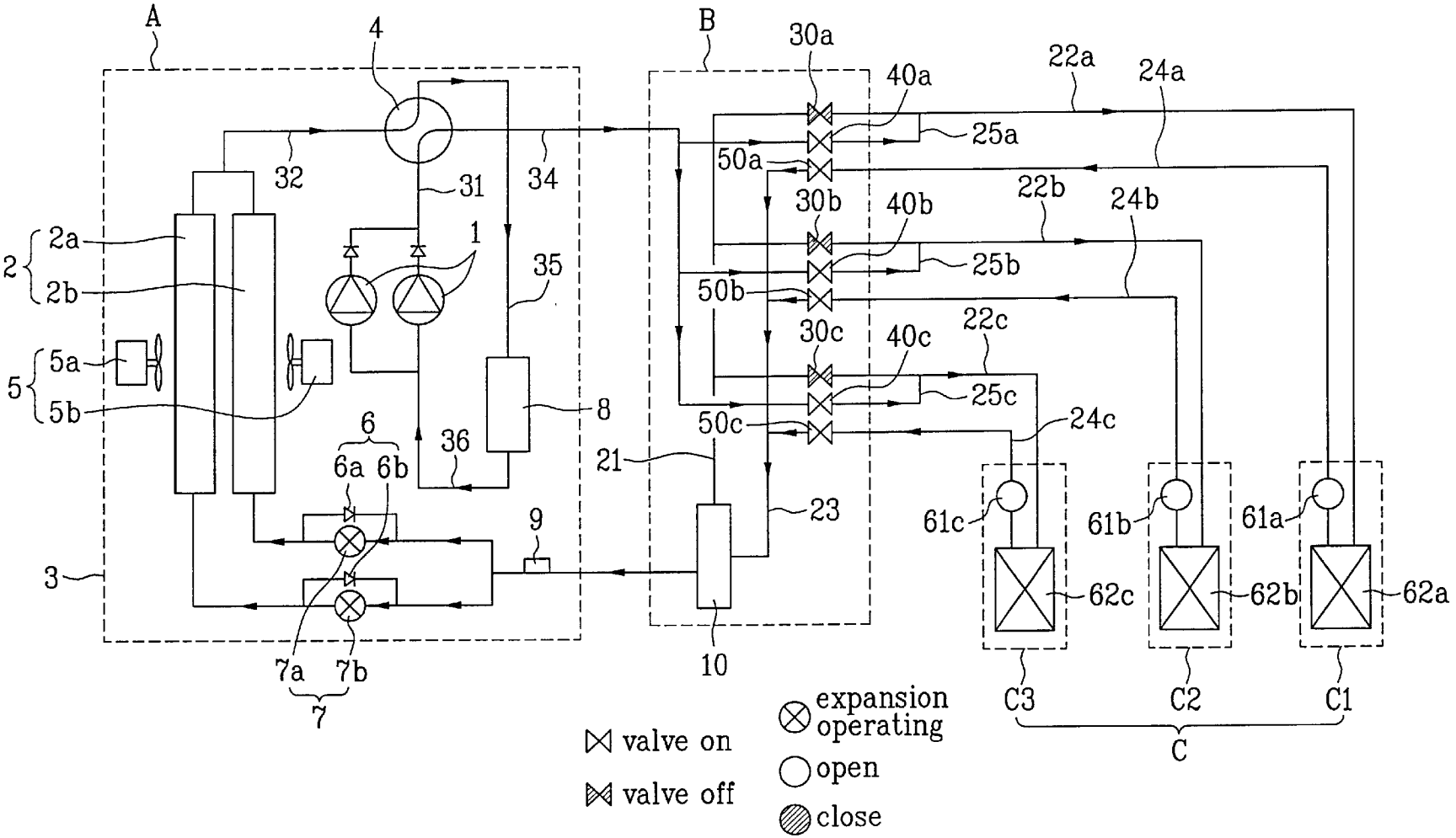
FIG. 2B illustrates a diagram showing an operation state of the multi-unit air conditioner in accordance with a preferred embodiment of the present invention when all rooms are heated.
Figure 3B:
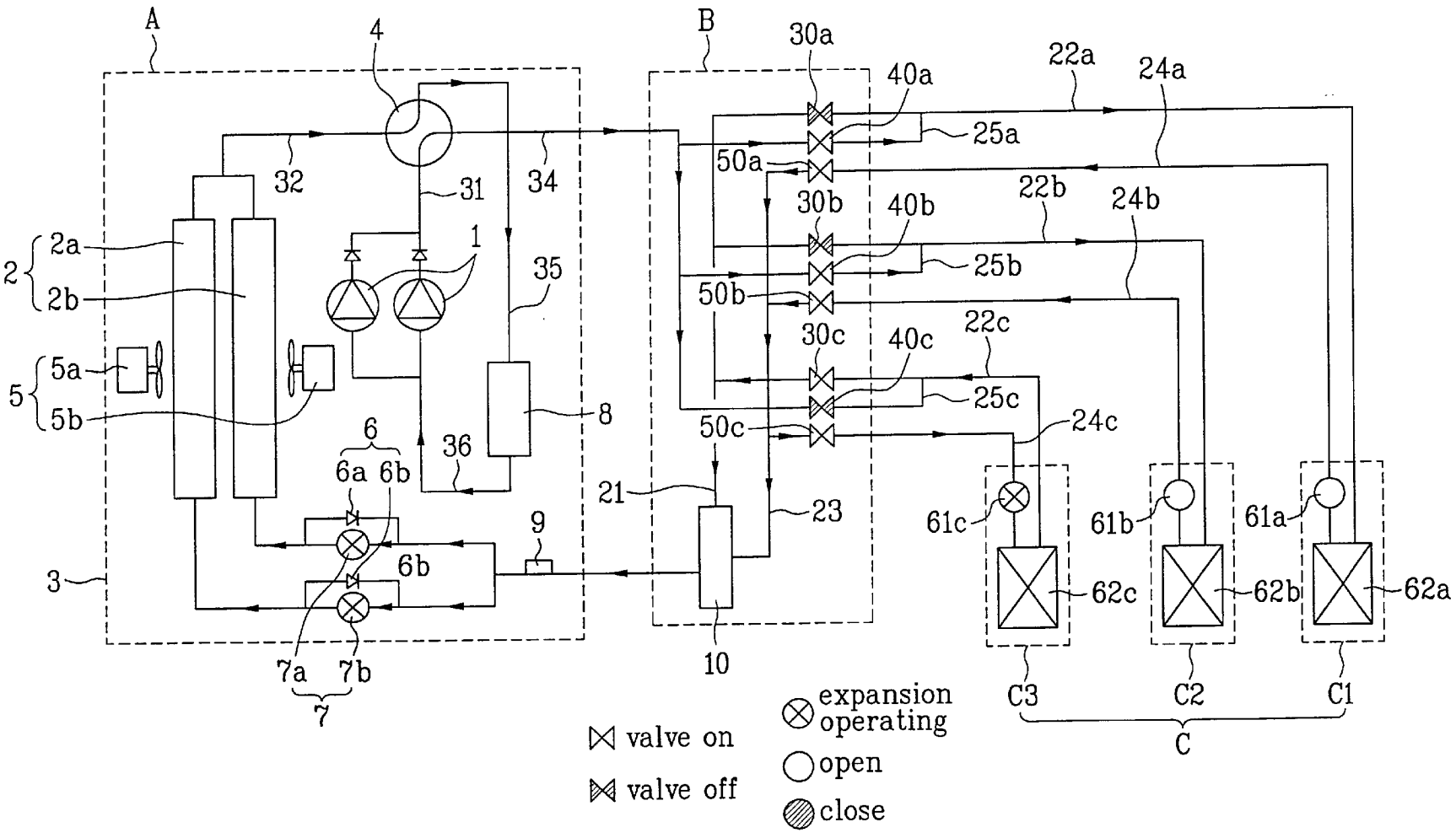
FIG. 3B illustrates a diagram showing an operation state of the multi-unit air conditioner in accordance with a preferred embodiment of the present invention in a major heating mode.

Referring to FIG. 2B or 3B, when the multi-unit air conditioner is in a heating mode, the four way valve 4 connects the first pipeline 31 and the fourth pipeline 34, so as to introduce the refrigerant from the compressor 1 to the distribution piping system.

The cooling mode refers to a case when the multi-unit air conditioner only cools the rooms, or is operated mainly for cooling, and the heating mode refers to a case when the multi-unit air conditioner only heats the rooms, or is operated mainly for heating.

Variation of the refrigerant flow path with operation conditions will become more apparent by description of operation of the multi-unit air conditioner with reference to the attached drawings, given later.

In the meantime, the control valves 6 and 7 include first and second check valves 6*a* and 6*b* provided on the third pipeline 33, and first, and second electronic expansion valves 7*a* and 7*b*. The first and second check valves 6*a* and 6*b* are provided on the first and second outdoor heat exchangers 2*a*, and 2*b*, for controlling refrigerant flow from the first and second outdoor heat exchangers 2*a* and 2*b* to the gas-liquid separator 10.

In more detail, the first and second check valves 6*a* and 6*b* pass refrigerant introduced from the first and second outdoor heat exchangers 2*a* and 2*b* to the gas-liquid separator 10 only. The first and second electronic expansion valves 7*a* and 7*b*, mounted in parallel to the first and second check valves 6*a* and 6*b*, causes to expand the refrigerant introduced from the gas-liquid separator 10 to the first and second outdoor heat exchangers 2*a* and 2*b* only. At the end, the refrigerant introduced from the first and the second outdoor heat exchangers 2*a* and 2*b* to the gas-liquid separator 10 is made to flow through the first and second check valves 6*a* and 6*b*, and the refrigerant introduced from the gas-liquid separator 10 to the first and second outdoor heat exchangers 2*a* and 2*b* is made to flow through the first and second electronic expansion valves 7*a* and 7*b*.

The distributor 'B' is provided between the outdoor unit 'A' and the plurality of indoor units C1, C2, and C3. As described, the distributor 'B' includes the gas-liquid separator 10 and the distribution piping system.

The distribution piping system includes a liquid refrigerant pipeline 23, liquid refrigerant branch pipelines 24*a*, 24*b*, and 24*c*, a gas refrigerant pipeline 21, gas refrigerant branch pipelines 22*a*, 22*b*, and 22*c*, and intermediate branch pipelines 25*a*, 25*b*, and 25*c*.

The liquid refrigerant pipeline 23, is connected to the gas-liquid separator 10, and guides liquid refrigerant to/from the gas-liquid separator 10. The liquid refrigerant branch pipelines 24*a*, 24*b*, 24*c*, branched from the liquid refrigerant pipeline 23, are connected to the indoor heat exchangers 62*a*, 62*b*, and 62*c*, respectively. The gas refrigerant pipeline 21, connected to the gas-liquid separator 10, guides gas refrigerant to/from the gas-liquid separator 10. The gas refrigerant branch pipelines 22*a*, 22*b*, and 22*c* are branched from the gas refrigerant pipeline 21 and connected to the indoor heat exchangers 62*a*, 62*b*, and 62*c*, respectively. The intermediate branch pipelines 25*a*, 25*b*, and 25*c* are respectively branched from the gas refrigerant branch pipelines 22*a*, 22*b*, and 22*c*, and connected to the fourth pipeline 34. The intermediate branch pipelines 25*a*, 25*b*, and 25*c* guide the refrigerant heat exchanged at the indoor units to the outdoor unit piping system, or the refrigerant introduced thereto from the outdoor unit piping system to the indoor heat exchangers 62*a*, 62*b*, and 62*c* depending on an operation condition.

It is preferable that the gas refrigerant branch pipelines 22*a*, 22*b*, and 22*c* and the liquid refrigerant branch pipelines 24*a*, 24*b*, and 24*c* are arranged in parallel, for putting the gas refrigerant branch pipelines 22*a*, 22*b*, and 22*c* and the liquid refrigerant branch pipelines 24*a*, 24*b*, and 24*c* into one duct (not shown) in piping work, that reduces a number of pipe run, to reduce working efficiency and an outer appearance. Moreover, putting the gas refrigerant branch pipelines 22*a*, 22*b*, and 22*c* and the liquid refrigerant branch pipelines 24*a*, 24*b*, and 24*c* into a duct from the starting to produce the gas refrigerant branch pipelines 22*a*, 22*b*, and 22*c* and the liquid refrigerant branch pipelines 24*a*, 24*b*, and 24*c* as one pipeline improves a piping work efficiency further.

In the meantime, the distributor 'B' includes a valve unit for controlling refrigerant flow in the distribution piping system. The valve unit makes the refrigerant to be introduced into the indoor units selected from the plurality of indoor units depending on an operation condition.

In more detail, the valve unit includes a plurality of valves 30*a*, 30*b*, 30*c*, 40*a*, 40*b*, 40*c*, 50*a*, 50*b*, and 50*c*, mounted on the gas refrigerant branch pipelines 22*a*, 22*b*, and 22*c*, the liquid refrigerant branch pipelines 24*a*, 24*b*, and 24*c*, and the intermediate branch pipelines 25*a*, 25*b*, and 25*c*. It is preferable that the valves are of two way type to be turned ON/OFF selectively depending on an operation condition.

Lastly, the indoor heat exchangers 62*a*, 62*b*, and 62*c* are connected to the distribution piping system. Particularly, the indoor heat exchangers 62*a*, 62*b*, and 62*c* are connected to the gas refrigerant branch pipelines 22*a*, 22*b*, and 22*c*, and the liquid refrigerant branch pipelines 24*a*, 24*b*, and 24*c*, respectively.

The description of the multi-unit air conditioner of the present invention up to now is based on an assumption that there are two outdoor heat exchangers, and three indoor heat exchangers. However, numbers of the outdoor heat exchangers and the indoor heat exchangers may vary with operation environments and conditions, and with which, system and number of the valve unit may vary.

The operation of the multi-unit air conditioner of the present invention, and refrigerant flow according to the operation will be described, with reference to FIGS. 2A~3B.

Before starting the description, it is assumed that the multi-unit air conditioner of the present invention has two outdoor heat exchangers and three indoor units C1, C2, and C3. It is also assumed that two indoor units C2 and C3 cool the rooms, and one indoor unit C1 heats the room in a major cooling mode in which the multi-unit air conditioner of the present invention is in operation mostly for cooling. Opposite to this, it is assumed that two indoor units C2 and C3 heat the rooms, and one indoor unit C1 cools the room in a major heating mode in which the multi-unit air conditioner of the present invention is in operation mostly for heating.

Of course, when the multi-unit air conditioner only cools or heats the rooms, all the indoor units cool or heat the rooms.

Referring to FIG. 2A, when the multi-unit air conditioner of the present invention only cools the rooms, the gas refrigerant from the compressor 1 flows through the first pipeline 31. Then, the refrigerant is made to be introduced into the first and second outdoor heat exchangers 2*a* and 2*b* through the second pipeline 32 by the four way valve 4. In this instance, the refrigerant introduced into the first outdoor heat exchanger 2*a* is subcooled by air blowing of the first outdoor fan 5*a*. The refrigerant introduced into the second outdoor heat exchanger 2*b* is subcooled by the air blowing of the second outdoor fan 5*b* driven under the control of the control means. As described before, the control means includes the temperature sensor 9 and the microcomputer.

Then, the subcooled refrigerant flows through the third pipeline 33, and is introduced into the gas-liquid separator 10 through the first and second check valves 6*a* and 6*b*. In this instance, the first and second electronic expansion valves 7*a* and 7*b* mounted in parallel to the first and second check valves 6*a* and 6*b* are closed.

Then, the liquid refrigerant is introduced into the liquid refrigerant pipeline 23, and branched to the liquid refrigerant branch pipelines 24*a*, 24*b*, and 24*c*. The branched refrigerant expands as the refrigerant passes through the electronic expansion valves 61*a*, 61*b*, and 61*c*. Thereafter, the refrigerant cools the rooms as the refrigerant passes through the indoor heat exchangers 62*a*, 62*b*, and 62*c*.

Gas refrigerant evaporated as the refrigerant passes through the indoor heat exchangers 62*a*, 62*b*, and 62*c* is introduced into the intermediate branch pipelines 25*a*, 25*b*, and 25*c* through the gas refrigerant branch pipelines 22*a*, 22*b*, and 22*c*. In this instance, the two way valves 30*a*, 30*b*, and 30*c* on the gas refrigerant branch pipelines are closed. Then, the refrigerant is introduced into the fifth pipeline 35 through the fourth pipeline 34 by the four way valve 4. Then, the refrigerant is drawn into the compressor 1 through the sixth pipeline 36 through the accumulator 8.

Referring to FIG. 2B, when the multi-unit air conditioner of the present invention only cools the rooms, the gas refrigerant from the compressor 1 flows through the first pipeline 31. Then, the refrigerant is introduced into the intermediate branch pipelines 25*a*, 25*b*, and 25*c* through the fourth pipelines 34 by the four way valve 4. Thus, different from the case when the refrigerant cools the rooms, the gas refrigerant does not pass through the outdoor heat exchangers 2.

Then, the gas refrigerant heats the rooms as the gas refrigerant is introduced into the gas refrigerant branch pipelines 22*a*, 22*b*, and 22*c*, passes, and condenses through the indoor heat exchangers 62*a*, 62*b*, and 62*c*. The refrigerant is introduced into the gas-liquid separator 10 through the electronic expansion valves 61*a*, 61*b*, and 61*c*, the liquid refrigerant branch pipelines 24*a*, 24*b*, and 24*c*, and the liquid refrigerant pipeline 23. The refrigerant flows from the gas-liquid separator 10 to, and expands at the first and second electronic expansion valves 7*a*, and 7*b*, and is introduced into the first and second heat exchangers 2*a* and 2*b*. Then, the refrigerant is drawn into the compressor 1 through the four way valve 4 and the accumulator 8.

Referring to FIG. 3A, when the multi-unit air conditioner of the present invention is operated in a major cooling mode, the gas refrigerant from the compressor 1 flows through the first pipeline 31. Then, the refrigerant is introduced into the first and second outdoor heat exchangers 2*a* and 2*b* through the second pipeline 32 by the four way valve 4. In this instance, the refrigerant introduced into the first outdoor heat exchanger 2*a* is subcooled by the air blowing of the first outdoor fan 5*a*. Then, the refrigerant introduced into the second outdoor heat exchanger 2*b* becomes two phased refrigerant having a refrigerant mixing ratio required for an operation condition by the air blowing of the second outdoor fan 5*b*. As described before, a rotating speed of the second outdoor fan 5*b* is determined by the control means having the temperature sensor 9 and the microcomputer.

Thereafter, the refrigerant flow through the third pipeline 33, and introduced into the gas-liquid separator 10 through the first and second check valves 6*a*, and 6*b*. In this instance, the first and second electronic expansion valves 7*a*, and 7*b* mounted in parallel to the first and second check valves 6*a* and 6*b* are closed.

In the meantime, the refrigerant mixing ratio of the refrigerant introduced into the gas-liquid separator 10 is controlled to be the same with a refrigerant mixing ratio preset by the control means. The refrigerant mixing ratio is determined to be proper to the two indoor units C2 and C3 for cooling which require liquid refrigerant and the indoor unit C1 for heating which requires gas refrigerant. The refrigerant mixing ratio is also determined with reference to a flow rate of the refrigerant introduced into the two indoor units C2 and C3 for cooling through the one indoor unit C1 for heating. Thus, the refrigerant mixing ratio is an experimental value determined by an experiment carried out under different conditions.

The high pressure two phased refrigerant introduced into the gas-liquid separator 10 is separated into liquid refrigerant and gas refrigerant. The liquid refrigerant is introduced into the liquid refrigerant pipeline 23 and branched to the liquid refrigerant branch pipelines 24*b* and 24*c*. Thereafter, the liquid refrigerant expands as the refrigerant passes through the electronic expansion valves 61*b* and 61*c* of the indoor units C2 and C3, and evaporated, and cool the rooms as the refrigerant passes through the indoor heat exchangers 62*b* and 62*c*.

In the meantime, separated gas refrigerant is introduced into the gas refrigerant pipeline 21. Then, the gas refrigerant is introduced into selected gas refrigerant branch pipeline 22*a*, and heats the room which requires heating as the refrigerant passes through the indoor heat exchanger 62*a*. Then, the refrigerant, passed through the indoor heat exchanger 62*a*, passes through opened electronic expansion valve 61*a* of the indoor unit C1, and the liquid refrigerant branch pipeline 24*a*, and introduced into the liquid refrigerant pipeline 23, and joins with the liquid refrigerant.

Thus, the gas refrigerant separated at the gas-liquid separator 10 also cools the rooms together with the liquid refrigerant separated at the gas-liquid separator 10 after the gas refrigerant heats the rooms.

The liquid refrigerant is introduced only into the selected liquid refrigerant branch pipelines 24*b* and 24*c* because of a pressure difference of the refrigerant. In more detail, a pressure of the liquid refrigerant from the liquid refrigerant branch pipeline 24*a* is controlled to be higher than a pressure of the refrigerant into the liquid refrigerant branch pipelines 24*a*. According to this, the liquid refrigerant is introduced only into the selected liquid refrigerant branch pipelines 24*b* and 24*c*.

The refrigerant evaporated as the refrigerant passes through the indoor heat exchangers 62*b* and 62*c* is introduced into the intermediate branch pipelines 25*b* and 25*c* through the gas refrigerant branch pipelines 22*b* and 22*c*. In this instance, the two way valves 30*b* and 30*c* are closed. Thereafter, the refrigerant flows through the fourth pipeline 34, and introduced into the fifth pipeline 35 by the four way valve 4. Then, the refrigerant is drawn into the compressor 1 through the sixth pipeline 36 and the accumulator 8.

Referring to FIG. 3B, when the multi-unit air conditioner of the present invention is operated in a major heating mode, the gas refrigerant from the compressor 1 flows through the first pipeline 31. Then, the refrigerant is introduced into selected intermediate branch pipelines 25*a* and 25*b* through the fourth pipeline 34 by the four way valve 4*a*. Thus, the gas refrigerant from the compressor 1 does not pass through the outdoor heat exchangers 2*a* and 2*b*. The refrigerant is introduced into selected intermediate branch pipelines 25*a* and 25*b* as the two way valve 40*c* is closed.

The high pressure gas refrigerant is introduced from the selected intermediate branch pipelines 25*a* and 25*b* to the gas refrigerant branch pipelines 22*a* and 22*b*. Then, the refrigerant passes, and is condensed at the indoor heat exchangers 62*a* and 62*b*, to heat the rooms. Then, the refrigerant flows through opened electronic expansion valves 61*a*, and 61*b* of the indoor units, the liquid refrigerant branch pipelines 24*a*, and 24*b*, and the liquid refrigerant pipeline 23. In this instance, a portion of the liquid refrigerant is introduced into the gas-liquid separator 10 through the liquid refrigerant pipeline 23. At the same time, rest of the liquid refrigerant is introduced into selected liquid refrigerant branch pipeline 24*c*, and passes through, and expands at the electronic expansion valve 61*c* of the indoor heat exchanger 62*c*. Then, expanded refrigerant is evaporated at the indoor heat exchanger 62*c*, to cool the room which requires cooling. Then, the refrigerant passes through the gas refrigerant branch pipeline 22*c* and the gas refrigerant pipeline 21 in succession, and is introduced into the gas-liquid separator 10.

The liquid refrigerant is introduced only to the selected liquid refrigerant branch pipeline 24*c* because of a pressure difference. In more detail, a pressure of the refrigerant flowing out of the liquid refrigerant branch pipelines 24*a* and 24*b* is controlled to be higher than a pressure of the refrigerant introduced into the liquid refrigerant branch pipeline 24*c*. Therefore, the liquid refrigerant is introduced only into the selected liquid refrigerant branch pipeline 24*c*.

The gas/liquid refrigerant introduced into the gas-liquid separator 10 is mixed at the gas-liquid separator 10, flows through the third pipeline 33, passes through, and expands at the electronic expansion valves 7*a* and 7*b*. Then, the refrigerant is introduced into the first and second outdoor heat exchangers 2*a* and 2*b*, flows through the second pipeline 32, and introduced into the fifth pipeline 35 through the four way valve 4. The refrigerant is drawn into the compressor 1 through the accumulator 8 and the sixth pipeline 36.

In the meantime, a method for controlling a multi-unit air conditioner of the present invention will be described, with reference to the operation of the multi-unit air conditioner.

A temperature of the refrigerant introduced into the gas-liquid separator 10 through the outdoor unit piping system from the plurality of outdoor heat exchangers 2 is measured with the temperature sensor 9. Then, a measured refrigerant temperature and a preset refrigerant temperature are compared, to detect the refrigerant mixing ratio in the outdoor unit piping system. If a detected mixing ratio is different from a mixing ratio preset proper to an operation condition, a rotation speed of the outdoor fans 5 are controlled. That is, if a flow rate of the liquid refrigerant of the measured mixing ratio is greater than a flow rate of the preset mixing ratio, a flow rate of the gas refrigerant is increased by reducing the rotation speed of the outdoor fans 5 which cool the outdoor heat exchangers 2. Opposite to this, if it is determined that the flow rate of the gas refrigerant is greater, the rotation speed of the outdoor fans 5 is increased, to increase the flow rate of the liquid refrigerant. Those operations are carried out under the control of a microcomputer.

As has been described, the multi-unit air conditioner and method for controlling the same have the following advantages.

First, optimal operation suitable to each room is possible. That is, even in a case there are rooms in a building having a plurality of rooms, that have temperature differences depending on locations of rooms or a time of a day, or a case of a computer room that requires cooling not only in summer but also in winter, an optimal operation can be carried out by carrying out major cooling/heating mode operation as required.

Second, the optimization of the refrigerant introduced into the gas-liquid separator proper to an operation condition improves an air conditioning efficiency.

Third, the gas liquid branch pipelines and the liquid refrigerant branch pipelines, connecting the distributor and the indoor units, can be arranged in parallel to each other. Therefore, the piping work is easy, and an outer appearance is improved when one duct is used, which enables to reduce a number of piping run.

Fourth, the use of inexpensive two way valves instead of three, or four way valves in the valve unit of the distributor permits to reduce a production cost.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A multi-unit air conditioner comprising:

an outdoor unit including;

an accumulator, a plurality of compressors and outdoor heat exchangers connected with an outdoor unit piping system, a plurality of outdoor fans for respectively cooling the outdoor heat exchangers, a four way valve and a plurality of control valves mounted on the outdoor unit piping system for controlling refrigerant flow;

a plurality of indoor units respectively installed in rooms each having an indoor heat exchanger and an electronic expansion valve;

a distributor including a gas-liquid separator for separating refrigerant received from the outdoor unit into gas refrigerant and liquid refrigerant, or mixing refrigerant received from the indoor units, and a distribution piping system for guiding the refrigerant from the outdoor unit toward the indoor units and the refrigerant from the indoor units to the outdoor unit again; and control means for controlling rotation speeds of the outdoor fans, to control a gas/liquid refrigerant mixing ratio introduced into the gas-liquid separator through the outdoor heat exchangers.

2. The multi-unit air conditioner as claimed in claim 1, wherein the outdoor heat exchanger includes;

a first outdoor heat exchanger for discharging liquid refrigerant proper to an operation condition; and a second outdoor heat exchanger for discharging two phased refrigerant proper to the operation condition.

3. The multi-unit air conditioner as claimed in claim 1, wherein the outdoor fan includes;

a first outdoor fan for condensing refrigerant at the first outdoor heat exchanger; and a second outdoor fan for condensing refrigerant at the second outdoor heat exchanger.

4. The multi-unit air conditioner as claimed in claim 1, wherein the control means includes;

a temperature sensor for measuring a temperature of refrigerant introduced from the outdoor heat exchangers into the gas-liquid separator, and a microcomputer for comparing a refrigerant temperature measured with the temperature sensor and a preset refrigerant temperature, to detect a refrigerant mixing ratio at the outdoor unit piping system, and controlling rotation speeds of the outdoor fans so that detected refrigerant mixing ratios are the same with refrigerant mixing ratios preset to be proper to operation conditions, respectively.

5. The multi-unit air conditioner as claimed in claim 4, wherein the refrigerant is R407C mix refrigerant of which refrigerant mixing ratio can be known accurately according to a temperature variation.

6. The multi-unit air conditioner as claimed in claim 1, wherein the outdoor unit piping system includes;

a first pipeline connected between outlets of the compressors and the four way valve, a second pipeline branched into two pipeline in front of the first and second outdoor heat exchangers, and connected between the four way valve and the first and second outdoor heat exchangers in parallel, a third pipeline joined in front of the gas-liquid separator, and connected between the gas-liquid separator and the outdoor heat exchangers in parallel a fourth pipeline connected between the distribution piping system and the four way valve, a fifth pipeline connected between the four way valve and the accumulator, and a sixth pipeline connected between the accumulator and an inlet of the compressor.

7. The multi-unit air conditioner as claimed in claim 6, wherein the outdoor heat exchangers include;

a first outdoor heat exchanger for discharging liquid refrigerant proper to an operation condition; and a second outdoor heat exchanger for discharging two phased refrigerant proper to the operation condition.

8. The multi-unit air conditioner as claimed in claim 7, wherein the outdoor fans include;

a first outdoor fan for condensing refrigerant at the first outdoor heat exchanger; and a second outdoor fan for condensing refrigerant at the second outdoor heat exchanger.

9. The multi-unit air conditioner as claimed in claim 8, wherein the control means includes;

a temperature sensor provided at a part the third pipeline joins for measuring a temperature of refrigerant introduced from the first and second outdoor heat exchangers into the gas-liquid separator, and a microcomputer for comparing a refrigerant temperature measured with the temperature sensor and a preset refrigerant temperature, to detect a refrigerant mixing ratio at the outdoor unit piping system, and controlling a rotation speed of the second outdoor fan so that detected refrigerant mixing ratios are the same with refrigerant mixing ratios preset to be proper to operation conditions, respectively.

10. The multi-unit air conditioner as claimed in claim 7, wherein the control valve includes;

first, and second check valves provided on sides of the first, and second outdoor heat exchangers of the third pipeline for controlling a refrigerant flow from the first and second outdoor heat exchangers to the gas-liquid separator, and first and second electronic expansion valves provided in parallel with the first and second check valves for expanding refrigerant flowing from the gas-liquid separator to the first and second outdoor heat exchangers.

11. The multi-unit air conditioner as claimed in claim 1, wherein the distribution piping system includes;

a liquid refrigerant pipeline connected to the gas-liquid separator for guiding liquid refrigerant to/from the gas-liquid separator, liquid refrigerant branch pipelines branched from the liquid refrigerant pipeline, and connected to the indoor heat exchangers, respectively, a gas refrigerant pipeline connected to the gas-liquid separator for guiding gas refrigerant to/from the gas-liquid separator, gas refrigerant branch pipelines branched from the gas refrigerant pipeline and connected to the indoor heat exchangers, respectively, and intermediate branch pipelines respectively branched from the gas refrigerant branch pipelines, and connected to the outdoor unit piping system.

12. The multi-unit air conditioner as claimed in claim 1, wherein the gas refrigerant branch pipelines and the liquid refrigerant branch pipelines are arranged in parallel to each other for piping work efficiency.

13. The multi-unit air conditioner as claimed in claim 11, wherein the outdoor heat exchanger includes;

a first outdoor heat exchanger for discharging liquid refrigerant proper to an operation condition; and a second outdoor heat exchanger for discharging two phased refrigerant proper to the operation condition.

14. The multi-unit air conditioner as claimed in claim 13, wherein the outdoor fans include;

a first outdoor fan for condensing refrigerant at the first outdoor heat exchanger; and a second outdoor fan for condensing refrigerant at the second outdoor heat exchanger.

15. The multi-unit air conditioner as claimed in claim 14, wherein the outdoor unit piping system includes;

a first pipeline connected between outlets of the compressors and the four way valve, a second pipeline branched into two pipeline in front of the first and second outdoor heat exchangers, and connected between the four way valve and the first and second outdoor heat exchangers in parallel, a third pipeline joined in front of the gas-liquid separator, and connected between the gas-liquid separator and the first and second outdoor heat exchangers in parallel, a fourth pipeline connected between the intermediate branch pipelines and the four way valve, a fifth pipeline connected between the four way valve and the accumulator, and a sixth pipeline connected between the accumulator and the inlet of the compressor.

16. The multi-unit air conditioner as claimed in claim 15, wherein the control means includes;

a temperature sensor provided at a part the third pipeline joins for measuring a temperature of refrigerant introduced from the first and second outdoor heat exchangers into the gas-liquid separator, and a microcomputer for comparing a refrigerant temperature measured with the temperature sensor and a preset refrigerant temperature, to detect a refrigerant mixing ratio at the outdoor unit piping system, and controlling a rotation speed of the second outdoor fan so that detected refrigerant mixing ratios are the same with refrigerant mixing ratios preset to be proper to operation conditions, respectively.

17. The multi-unit air conditioner as claimed in claim 15, wherein the control valve includes;

first, and second check valves provided on sides of the first, and second outdoor heat exchangers of the third pipeline for controlling a refrigerant flow from the first and second outdoor heat exchangers to the gas-liquid separator, and first and second electronic expansion valves provided in parallel with the first and second check valves for expanding refrigerant flowing from the gas-liquid separator to the first and second outdoor heat exchangers.

18. The multi-unit air conditioner as claimed in claim 11, wherein the distributor includes a valve unit for controlling refrigerant flow in the distribution piping system.

19. The multi-unit air conditioner as claimed in claim 18, wherein the valve unit includes two way valves provided on the gas refrigerant branch pipelines, the liquid refrigerant branch pipelines, and intermediate branch pipelines for being turned on/off selectively depending on operation conditions.

20. A method for operating a multi-unit air conditioner, comprising the steps of:

measuring a temperature of refrigerant introduced into a gas-liquid separator through an outdoor unit piping system from a plurality of outdoor heat exchangers with a temperature sensor;

comparing a measured refrigerant temperature and a preset refrigerant temperature, to detect a refrigerant mixing ratio flowing through the outdoor unit piping system; and controlling rotation speeds of a plurality of outdoor fans for cooling the outdoor heat exchangers, so that the detected mixing ratio becomes the same with a mixing ratio set proper to an operation condition.

* * * * *